US010526062B2

(12) United States Patent
Merchant et al.

(10) Patent No.: US 10,526,062 B2
(45) Date of Patent: Jan. 7, 2020

(54) SUBSEA REMOTELY OPERATED VEHICLE (ROV) HUB

(71) Applicant: Keppel Offshore & Marine Technology Centre Pte Ltd, Singapore (SG)

(72) Inventors: Aziz Amirali Merchant, Singapore (SG); Anis Altaf Hussain, Singapore (SG); Sreekala Kumar, Singapore (SG); Ankit Kumar Choudhary, Singapore (SG)

(73) Assignee: Kepple Offshore & Marine Technology Center Pte Ltd, Singapore (SG)

( * ) Notice: Subject to any disclaimer, the term of this patent is extended or adjusted under 35 U.S.C. 154(b) by 0 days.

(21) Appl. No.: 16/086,586

(22) PCT Filed: Mar. 21, 2017

(86) PCT No.: PCT/SG2017/050137
§ 371 (c)(1),
(2) Date: Sep. 19, 2018

(87) PCT Pub. No.: WO2017/164811
PCT Pub. Date: Sep. 28, 2017

(65) Prior Publication Data

US 2019/0100291 A1 Apr. 4, 2019

(30) Foreign Application Priority Data

Mar. 21, 2016 (SG) ..... 10201602188Y

(51) Int. Cl.
*B63G 8/00* (2006.01)
*B63C 11/40* (2006.01)
*B63B 27/16* (2006.01)

(52) U.S. Cl.
CPC ..... *B63G 8/001* (2013.01); *B63B 27/16* (2013.01); *B63C 11/40* (2013.01);
(Continued)

(58) Field of Classification Search
CPC ..... B63G 8/001; B63G 2008/007; B63G 2008/008; B63B 27/16; B63B 2027/165
See application file for complete search history.

(56) References Cited

U.S. PATENT DOCUMENTS 6,260,504 B1 * 7/2001 Moles ..... B63B 27/36 114/312
2009/0178848 A1 * 7/2009 Nellessen, Jr. ..... E21B 7/12 175/7

(Continued)

FOREIGN PATENT DOCUMENTS

AU 2012257715 11/2012
AU 2012257715 B2 * 7/2016 ..... B63C 11/52

(Continued)

OTHER PUBLICATIONS

International Search Report from Australian Patent Office dated Jun. 8, 2017 for relating International Application No. PCT/2017/050137.

(Continued)

*Primary Examiner* — S. Joseph Morano
*Assistant Examiner* — Jovon E Hayes
(74) *Attorney, Agent, or Firm* — Baker Hostetler

(57) ABSTRACT

This invention relates to a subsea Remotely Operated Vehicle (ROV) hub. In particular, the invention relates to a subsea ROV hub comprising a plurality of compartments for housing and deploying a plurality of ROVs.

15 Claims, 2 Drawing Sheets

(52) U.S. Cl.
CPC .. *B63B 2027/165* (2013.01); *B63G 2008/007* (2013.01); *B63G 2008/008* (2013.01)

(56) References Cited

U.S. PATENT DOCUMENTS

| | | | | |
|---|---|---|---|---|
| 2016/0121983 | A1* | 5/2016 | Rokkan | B63B 27/16 114/313 |
| 2019/0100291 | A1* | 4/2019 | Merchant | B63G 8/001 |

FOREIGN PATENT DOCUMENTS

| | | | |
|---|---|---|---|
| EP | 2845793 | | 3/2015 |
| GB | 2453645 | | 3/2012 |
| KR | 20140032250 | | 3/2014 |
| WO | WO2013/050411 | | 4/2013 |
| WO | WO-2013050411 | A2 * | 4/2013 |
| WO | WO2014/076075 | | 5/2014 |
| WO | WO2015/020529 | | 2/2015 |
| WO | WO2017/064503 | | 4/2017 |

OTHER PUBLICATIONS

Written Opinion from Australian Patent Office dated Jun. 8, 2017 for relating International Application No. PCT/2017/050137.
International Preliminary Report on Patentability Australian Patent Office dated Feb. 27, 2018 for relating International Application No. PCT/2017/050137.

* cited by examiner

SUBSEA REMOTELY OPERATED VEHICLE (ROV) HUB

CROSS REFERENCED APPLICATIONS

This application is a U.S. National Phase filing of PCT Application No. PCT/SG2017/050137 filed on Mar. 21, 2017 that claims priority to Singapore Patent Application No. 10201602188Y filed on Mar. 21, 2016, both of which are hereby incorporated by reference as if set forth herewith.

FIELD OF THE INVENTION

This invention relates to a subsea Remotely Operated Vehicle (ROV) hub. In particular, the invention relates to a subsea ROV hub for housing and deploying a plurality of ROVs.

BACKGROUND

The development and maintenance of a deep water oil field typical requires many ROVs support to carry out a variety of different tasks. When exploration takes place under semi-hazardous conditions such as at deep depths ocean or at offshore locations, Remotely Operated Vehicles (ROVs) are typically used to gain access to the particular site or location. ROVs may be used for servicing vessels out at sea and for completion of a variety of different underwater tasks. These ROVs are typically self-propelled and usually include a variety of linkages to allow activities such as the retrieval, maintenance and repair of equipment to be accomplished. ROVs are also typically provided with video recording equipment and lighting to allow the controller of the ROV to better manipulate the ROV so that the ROV may accomplish its tasks underwater.

Out at sea, ROVs are frequently deployed using tether management systems (TMS). A tether management system may include a cage or a carriage for storing the ROV inside or it can be a top hat type carriage with the ROV stored below it. The carriage with the ROV is lowered from a surface vessel into the sea using either a conventional winch system or alternatively as an Autonomous Underwater Vehicle. When the carriage reaches the surface of the seabed, the ROV disengages from the carriage and is then directed by the controller to the work site. To facilitate the operation of the ROV underwater, the ROV is either tethered to the surface vessel via a long cable, or connected to the subsea umbilical assembly point or to a subsea power station or to a shore power source. Through this cable, the ROV will receive power and signals transmitted from the surface vessel to the ROV.

When the ROV is not in use, ROVs are retrieved back to the surface vessel and is usually stored within the carriage and on the deck of the surface vessel. This typically results in multiple launching and retrieval of the ROVs which are time consuming and risky. One of the problems associated with this arrangement is the limited deck space available to house the carriage and the ROV on-board the vessel. Due to the limited deck space available, it is common for surface vessel to have only one ROV with the carriage at any one point of time. However, the downside of having only a single ROV on-board is that in the event that the single ROV faces technical difficulties, the ROV may need to be replaced with a replacement ROV. This often causes significant delays before a replacement ROV can be brought on-board the surface vessel. In addition, an additional ROV on-board would also mean additional deck space is required to house the additional ROV or multiple surface vessels are to be deployed.

Many existing ROV deployment systems have a tether management system or carriage that can house only a single ROV. Although there are some systems which are able to house more than one ROVs, such systems are often bulky, inefficient and unsafe to use in bad weather and/or occupy significant deck space when stored on-board a surface vessel.

It is therefore desirable to provide a subsea ROV hub that seeks to address at least one of the problems described hereinabove, or at least to provide an alternative.

SUMMARY OF INVENTION

The above and other problems in the art are solved and an advance in the art is made in accordance with some embodiments of this invention. In accordance with one aspect of the invention, a subsea ROV hub for housing and deploying a plurality of ROVs to a subsea location is provided. The subsea ROV hub comprises a frame structure having a base, a top, and a body, said body having a front, a back and two sides, and extending vertically from the base to the top, wherein the body comprises two or more compartments, each of the compartments having at least one opening for receiving the ROV and is configured to house the ROV within the hub. The hub also comprises a hoisting and control cable provided at an upper end of the hub for deploying and suspending the hub from a surface vessel, at least one umbilical reel provided at the upper end of the hub for connecting to ROV and returning ROV to the compartment and a mechanism provided at the upper end of the hub for disengaging the hub from the surface vessel. The hub further comprises a plurality of floodable tanks fitted with valves for flooding the tanks and a compressed air system for de-flooding the tanks.

In accordance with some embodiments of this invention, the two or more compartments are arranged one on top of another. In accordance with other embodiments of this invention, the two or more compartments are arranged horizontally side-by-side, adjacent to one another.

In accordance with many embodiments of this invention, each of the compartments has a base for supporting the ROV within the frame structure when the ROV is not in operation.

In accordance with a number of embodiments of this invention, the opening of each of the compartments is arranged on the same side of the hub. In accordance with other embodiments of this invention, the opening of each of the compartments is arranged on different sides of the hub to facilitate deployment of the ROV to different working sites.

In accordance with some embodiments of this invention, the frame structure comprises a plurality of legs for supporting the hub on the seabed.

In accordance with some embodiments of this invention, the hub further comprises a tool storage compartment. In accordance with one embodiment of this invention, the tool storage compartment is provided on the outer surface of the frame structure. In accordance with other embodiment of this invention, the tool storage compartment is provided within the frame structure.

In accordance with some embodiments of this invention, the hub further comprises at least two thrusters mounted to the frame structure.

In accordance with some embodiments of this invention, the frame structure further comprises horizontal, vertical and/or diagonal braces provided at the back and/or two sides of the body of the frame structure.

BRIEF DESCRIPTION OF THE DRAWINGS

The above advantages and features of a system in accordance with this invention are described in the following detailed description and are shown in the drawings.

DETAILED DESCRIPTION

This invention relates to a subsea Remotely Operated Vehicle (ROV) hub. In particular, the invention relates to a subsea ROV hub for housing and deploying a plurality of ROVs to a subsea location.

Figure 1:
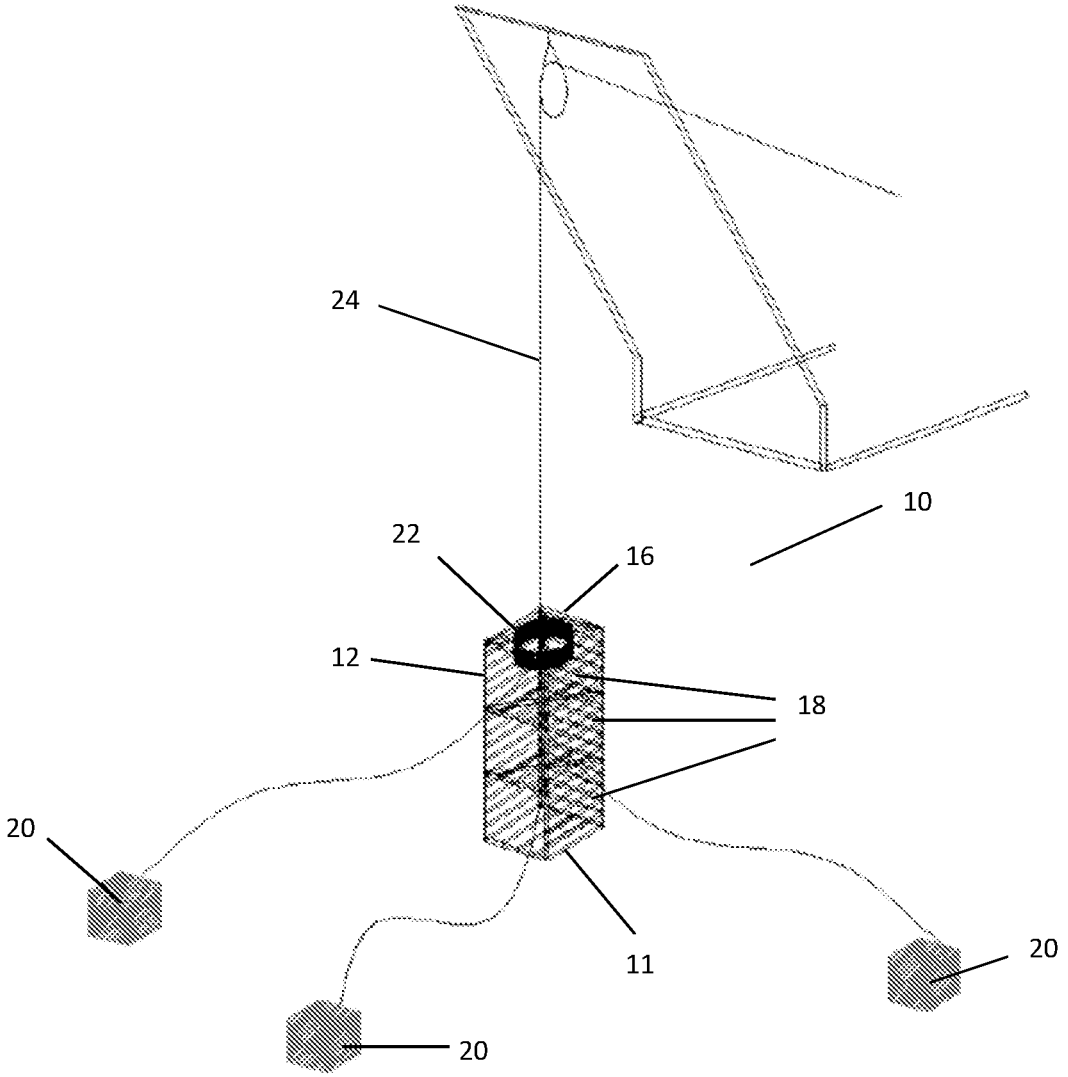
FIG. 1 illustrates a subsea ROV hub in accordance with an embodiment of the invention.

FIG. 1 shows a subsea ROV hub in accordance an embodiment of the invention. The subsea ROV hub (10) comprises a frame structure (12) having a base (14), a top (16), and a body, said body having a front, a back and two sides, and extending vertically from the base to the top. The body consists of two or more compartments (or garages) (18), each of the compartments is configured to receive and house a ROV (20) within the hub. The compartments may be arranged in any suitable configuration. In some embodiments, the compartments are arranged side-by-side, adjacent to one another. In some other embodiments, the compartments are arranged one on top of another. In still other embodiments, the compartments may be arranged with some adjacent to one another and some, one on top of another. Depending on the dimension of the ROV hub and the dimension of the compartments, any number of compartments may be utilized. In the embodiment shown in FIG. 1, three compartments are provided.

Each of the compartments (18) has at least one opening for receiving and deploying an ROV. In one embodiment, the opening of each of the compartments is arranged on the same side of the ROV hub. In other embodiments, the opening of each of the compartments is arranged on different sides of the ROV hub to facilitate deployment of the ROVs to different working sites.

The ROV hub (10) in accordance with some embodiments of the present invention may be of a frame structure, or an enclosed structure or a combination of both. In the frame structure, the frames are arranged in a configuration that allows the ROV hub to house and hold the ROV in place within the compartment when the ROV hub is lowered from a surface vessel into deep sea. In the enclosed structure or a combination of both the frame and enclosed structure, the structure is formed by having a mesh material covering the back and the two sides of the frame structure. The mesh material may be of any suitable form including, but not limited to, metal composite. The frame structure may further include horizontal, vertical and/or diagonal braces provided at the back and/or the two sides of the body of the frame structure. For vertical braces, the braces preferably extend from the base to the top of the frame structure. The ROV hub may be made of a single integral unit consisting of a plurality of compartments or a combination of different compartments assembled together to form the ROV hub.

Figure 2:
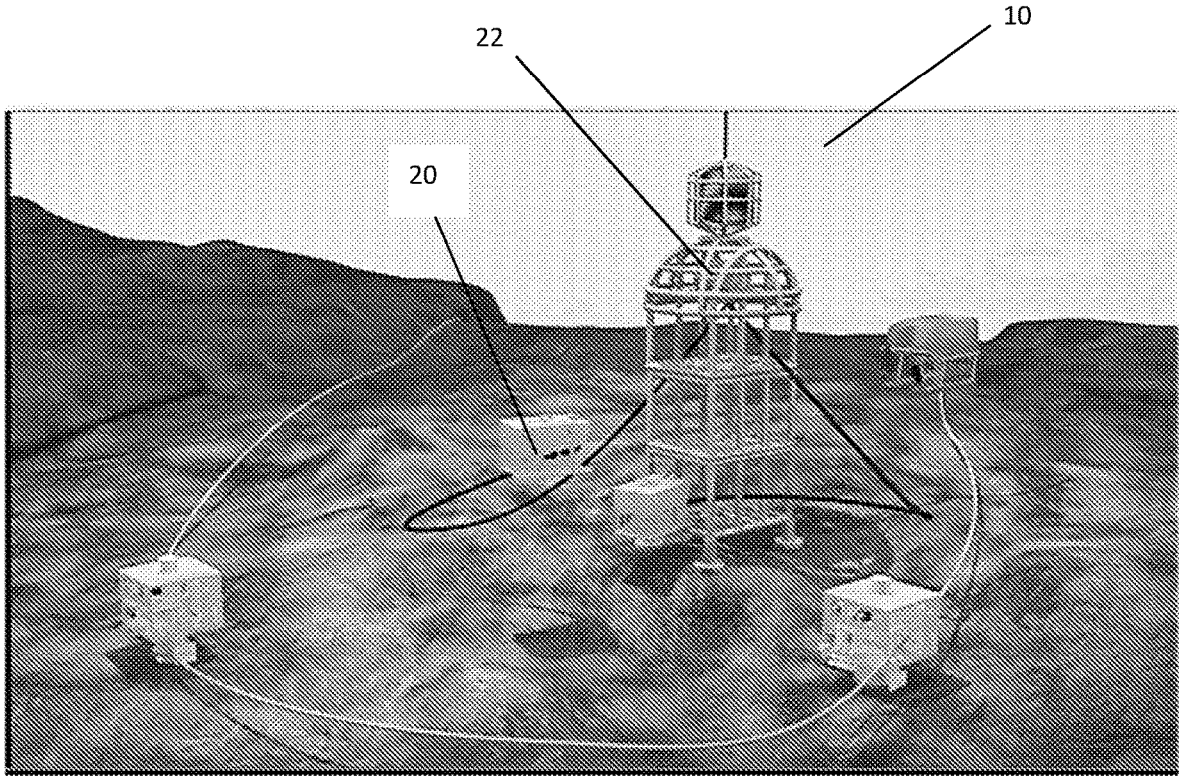
FIG. 2 illustrates a subsea ROV hub in accordance with another embodiment of the invention.

The ROV hub (10) in accordance with some embodiments of the present invention may be of any suitable shapes and sizes. Suitable shapes include, but are not limited to, rectangular, polygonal, square, circular, dome or irregular shape or a combination thereof. In the exemplary embodiment shown in FIG. 2, the top of the ROV hub is of a dome shape and the area where the plurality of compartments are provided, is of a rectangular shape. The size of the ROV hub should be sufficient to house at least two or more ROVs within the hub.

The ROV hub in accordance with many of the present invention can be configured to house ROVs which are tethered or untethered to the ROV hub. The ROV will be battery operated if untethered to the ROV hub. Both tethered and untethered ROVs can be controlled using sensors. Any suitable type of sensors can be used without departing from the scope of the invention.

The plurality of compartments provided within the ROV hub may be of any suitable shapes or sizes. Suitable shapes include, but are not limited to, rectangular, polygonal, square, etc. The compartments provided within the ROV hub may be of the same or different shapes. The shape chosen for the compartment should allow the compartment to house the type of ROV that it is designated to house. The size or dimensions of the compartments within a single ROV hub may be the same or they may be different depending on the types of ROVs that each of the compartments is designated to house for deployment to perform different tasks. Each of the compartments should be of a size sufficient to house at least one ROV.

The plurality of compartments provided within the ROV hub may be designed such that each of the compartments houses a designated ROV. In other words, each ROV is configured to be housed or parked within a dedicated compartment. In other embodiments, each ROV may be housed or parked in a compartment that is nearest to it after the ROV completed its task.

In accordance with a number of embodiments of the invention, the ROV hub is in a "free-flying" configuration. In this configuration, the hub is made neutrally buoyant so that it stays afloat in deep water. The hub can be fitted with thrusters to counteract the current forces to avoid drifting off.

In some other embodiments, the ROV hub is configured to sit on the seabed. In this embodiment, the bottom of the hub will be suitably fitted with structures to help distribute the load of the hub onto the seabed while the hub sits on the seabed. In one embodiment, the bottom of the hub is fitted with a plurality of legs for supporting the hub onto the seabed.

In yet still other embodiments, the ROV hub may be configured to move along the seabed. In this configuration, the bottom of the hub may be powered and fitted with tracks to enable it to move along the seabed.

Any suitable materials may be used to manufacture the ROV hub. Which material shall be used or how much buoyancy shall be provided to the ROV hub will be dependent on the ROVs and other equipment that are mounted within the ROV hub. In one embodiment, the material used should allow the ROV hub to sit securely on the seabed or to stay afloat in an upright position in deep water.

The ROV hub receives power from the surface vessel for operation of the plurality of ROVs via tethers as in conventional arrangement or connected to the subsea umbilical assembly point or to a subsea power station or to a shore power source. This feature has the advantage in that it allows untethered ROVs or battery operated ROVs to return to the ROV hub for charging when the battery runs out on a job-site in deep water. This helps to save time and costs as there is no need to bring the ROV back on-board the surface vessel for charging.

The ROV hub (10) has one or more umbilical reels (22) mounted at the top of the hub for connecting to each ROV and reeling each ROV to and away from the respective compartment where the ROV is housed. The umbilical reels (22) may be mounted within the ROV hub or external to the ROV hub. The reels can be positioned along the vertical axis or the horizontal axis of the ROV hub. Any suitable type of umbilical reels may be used without departing from the scope of the invention.

The ROV hub (10) may further include a tool storage compartment (not shown) for storing ROV tools. This enables the ROVs to change tools underwater when necessary. The tool storage compartment may be provided at one side of the hub or on top or at the bottom of the hub. The tool storage compartment may be of any suitable size that is sufficient to store the necessary tools that are required for use in the deployment.

To assist in the deployment and retrieval of the ROV hub (10), the ROV hub or each of the compartments may include a plurality of automatic floodable tanks and compressed air system for de-flooding the tanks. The floodable tanks are fitted with valves which when open, will automatically flood the tanks. The compressed air system is provided to push water out in case the tanks need to be emptied (or de-flooding). The automatic floodable tanks and the compressed air system may be positioned inside the ROV hub or coupled to an outside circumference of the ROV hub.

The ROV hub (10) further includes a hosting and control cable (24) provided at the upper end of the hub for deploying and suspending the hub from the surface vessel. The hub also includes a mechanism that allows quick disengagement of the hub from the tether system of the surface vessel or from the surface vessel in case of emergency. The hub will remain on the seabed and be disconnected from the surface vessel when disengagement is activated.

Some embodiments of the operation of the ROV hub is described herein below.

In operation, a ROV hub comprising a plurality of ROVs housed within a plurality of compartments is lowered into deep sea using a winch system. Once the ROV hub reaches the seabed, the plurality of ROVs housed within the plurality of compartments are launched. As the ROVs are launched and the respective umbilical reels dispensed, the stability of the ROV hub is adjusted as necessary by the floodable tanks. While the ROVs perform their tasks, the ROV hub remains in its position. If there is a need for an ROV to change tool, the ROV will return to the ROV hub for exchange of tools. Once the ROVs tasks are completed, each ROV may return to its designated compartment or to a compartment that is nearest to it. After all the ROVs are parked within the compartments, the ROV hub is lifted from the seabed and reeled back to the surface vessel to be stored on-board the vessel.

The ROV hub of the present invention has several advantages. One of which is that it provides increased subsea automation as a plurality of ROVs can be deployed at the same time in deep sea. This provides an efficient and cost saving ways of carrying out a variety of different task subsea at the same time. The ROV hub of the present invention is equipped with subsea power station and therefore, can provide long lasting ROVs. The invention allows offshore facilities such as drill rigs, platforms, oil fields, etc. to be self-sustaining in terms of subsea inspection and intervention. This allows rapid response to system failure or incidents involving subsea infrastructure. The invention also reduces weather and sea states sensitivity to ROV launch and recovery operations since the launching and recovering of ROVs will all be carried out close to seabed where the ROV hub is positioned.

The above is a description of the subject matter the inventors regard as the invention and is believed that others can and will design alternative systems that include this invention based on the above disclosure.

The invention claimed is:

1. A subsea remotely operated vehicle (ROV) hub for housing and deploying a plurality of ROVs to a subsea location, comprising:

a frame structure having a base, a top, and a body, said body having a front, a back and two sides, and extending vertically from the base to the top, wherein the body comprises three compartments, each of the compartments having at least one opening for receiving the ROV and is configured to house the ROV within the hub;

a tool storage compartment a hoisting and control cable provided at an upper end of the hub for deploying and suspending the hub from a surface vessel;

at least one umbilical reel provided at the upper end of the hub for connecting to the ROV and returning the ROV to the compartment;

a mechanism provided at the upper end of the hub for disengaging the hub from the surface vessel;

a plurality of floodable tanks fitted with valves for flooding the tanks and a compressed air system for de-flooding the tanks; and wherein the frame structure comprises a plurality of legs for supporting the hub onto the seabed.

2. The subsea ROV hub according to claim 1, wherein the three compartments are arranged one on top of another.

3. The subsea ROV hub according to claim 1, wherein the three compartments are arranged horizontally side-by-side, adjacent to one another.

4. The subsea ROV hub according to claim 1, wherein each of the compartments having a base for supporting the ROV within the frame structure when the ROV is not in operation.

5. The subsea ROV hub according to claim 1, wherein the opening of each of the compartments is arranged on the same side of the hub.

6. The subsea ROV hub according to claim 1, wherein the opening of each of the compartments is arranged on different sides of the hub to facilitate deployment of the ROV to different working sites.

7. The subsea ROV hub according to claim 1, wherein the legs are configured to allow the hub to move along the seabed.

8. The subsea ROV hub according to claim 1, wherein the tool storage compartment is provided on the outer surface of the frame structure.

9. The subsea ROV hub according to claim 1, wherein the tool storage compartment is provided within the frame structure.

10. The subsea ROV hub according to claim 1, further comprising:

at least two thrusters mounted to the frame structure.

11. The subsea ROV hub according to claim 1, wherein the frame structure further comprises horizontal, vertical and/or diagonal braces provided at the back and/or two sides of the body of the frame structure.

12. The subsea ROV hub according to claim 1, wherein the compartments are enclosed compartments having at least one opening for receiving ROV.

13. The subsea ROV hub according to claim 9, wherein the enclosed compartments are formed by having a mesh material covering the back and the two sides of the frame structure.

14. The subsea ROV hub according to claim 1, wherein the plurality of floodable tanks and the compressed air system are provided inside the ROV hub.

15. The subsea ROV hub according to claim 1, wherein the plurality of floodable tanks and the compressed air system are coupled to an outside circumference of the ROV hub.

* * * * *